US011187101B2

(12) United States Patent
Lee et al.

(10) Patent No.: US 11,187,101 B2
(45) Date of Patent: Nov. 30, 2021

(54) VARIABLE GEOMETRY TURBOCHARGER

(71) Applicants: Hyundai Motor Company, Seoul (KR); Kia Motors Corporation, Seoul (KR)

(72) Inventors: Jang Sin Lee, Gyeonggi-do (KR); Jun Hee Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 99 days.

(21) Appl. No.: 16/686,399

(22) Filed: Nov. 18, 2019

(65) Prior Publication Data

US 2021/0033002 A1 Feb. 4, 2021

(30) Foreign Application Priority Data

Jul. 30, 2019 (KR) ..... 10-2019-0092547

(51) Int. Cl.
*F01D 17/14* (2006.01)
*F01D 25/28* (2006.01)

(52) U.S. Cl.
CPC ..... *F01D 17/141* (2013.01); *F01D 25/28* (2013.01); *F05D 2220/40* (2013.01)

(58) Field of Classification Search
CPC ..... F01D 17/141; F01D 25/28; F01D 17/165; F05D 2220/40; F05D 2260/56; F05D 2260/38
USPC ..... 416/160
See application file for complete search history.

(56) References Cited

U.S. PATENT DOCUMENTS

2004/0096317 A1* 5/2004 Scholz ..... F01D 17/165 415/160
2008/0240906 A1* 10/2008 Barthelet ..... F01D 17/165 415/148
2019/0178259 A1* 6/2019 McCabe ..... F25B 31/026

FOREIGN PATENT DOCUMENTS

| | | | | | |
|---|---|---|---|---|---|
| CN | 101542075 | A | * | 9/2009 | F01D 17/165 |
| CN | 102121401 | A | * | 7/2011 | F01D 17/165 |
| CN | 102121401 | B | * | 5/2016 | F01D 17/165 |
| DE | 102012206855 | A1 | * | 5/2013 | F01D 17/165 |
| EP | 0896157 | B1 | * | 10/2003 | F04D 29/464 |
| EP | 2592239 | A2 | * | 5/2013 | F01D 17/165 |
| EP | 3282097 | A1 | * | 2/2018 | F02B 37/24 |
| JP | 2002038964 | A | * | 2/2002 | |
| JP | 2004084545 | A | * | 3/2004 | |
| JP | 2005207373 | A | * | 8/2005 | |
| JP | 2009180111 | A | * | 8/2009 | |
| JP | 2010180864 | A | * | 8/2010 | |
| JP | 2013163972 | A | * | 8/2013 | |
| KR | 10-2011-0063163 | A | | 6/2011 | |
| KR | 20110063163 | A | * | 6/2011 | |

* cited by examiner

*Primary Examiner* — J. Todd Newton
(74) *Attorney, Agent, or Firm* — Mintz Levin Cohn Ferris Glovsky and Popeo, P.C.; Peter F. Corless

(57) ABSTRACT

A variable geometry turbocharger (VGT) is provided. The VGT includes a unison ring that rotates a plurality of vanes disposed in a nozzle ring and a sagging prevention mechanism. The sagging prevention mechanism is installed to support the unison ring in a direction opposite to a direction in which a self-weight of the unison ring acts. In particular, the sagging prevention mechanism includes a support pulley that is installed to provide an elastic pressure on an outer circumferential surface of the unison ring in rolling contact therewith.

8 Claims, 4 Drawing Sheets

VARIABLE GEOMETRY TURBOCHARGER

CROSS REFERENCE TO RELATED APPLICATION

The present application claims priority to Korean Patent Application No. 10-2019-0092547, filed Jul. 30, 2019, the entire contents of which is incorporated herein for all purposes by this reference.

BACKGROUND

1. Technical Field

The present disclosure relates to a structure of a variable geometry turbocharger (VGT) for supercharging with intake air in an engine, and more particularly, to a structure of a VGT that improves stability in controlling vanes therein.

2. Description of the Related Art

The VGT has a plurality of vanes for changing an angle at which exhaust gas in a vehicle engine is supplied to a turbine wheel, and the plurality of vanes are configured to operate by and together with a unison ring. The unison ring is connected to an actuator through a link structure. Once the actuator provides a driving force to rotate the unison ring, the plurality of vanes rotate together, thereby making it possible to adjust a flow rate at which the exhaust gas is incident to the turbine wheel. The unison ring is repeatedly rotated by the actuator as described above, and a plurality of guide rollers are provided inside the unison ring to fix the position of the unison ring and to guide the rotation thereof.

The repeated rotations of the unison ring cause abrasion between the guide rollers and the unison ring as the time for which the VGT has been used elapses. The abrasion phenomenon is affected in a direction in which a self-weight of the unison ring acts, causing the unison ring to sag downwards compared to an initial state. Accordingly, the angles of the vanes when the unison ring sags downwards change from that angles in the initial state, resulting in the reduced accuracy in controlling the VGT.

The contents described as the related art have been provided merely to assist in understanding the background of the present disclosure and should not be considered as corresponding to the related art known to those having ordinary skill in the art.

SUMMARY

An object of the present disclosure is to provide a variable geometry turbocharger (VGT) for suppressing and preventing a change in a position of a unison ring from an initial state according to the position change as the time for which the VGT has been used elapses, thereby improving accuracy and stability in controlling vanes in the VGT.

According to an exemplary embodiment of the present disclosure, a variable geometry turbocharger may include: a unison ring provided to rotate a plurality of vanes disposed in a nozzle ring; and a sagging prevention mechanism installed to support the unison ring in a direction opposite to a direction in which a self-weight of the unison ring acts.

The sagging prevention mechanism may include a support pulley installed to provide an elastic pressure on an outer circumferential surface of the unison ring in rolling contact therewith. Additionally, the sagging prevention mechanism may include: a lower body fixed to the nozzle ring; an upper body installed in a rotatable state relative to the lower body and fixing the support pulley in the rotatable state; and a spring installed to apply an elastic force in a rotational direction between the lower body and the upper body.

The lower body may have an axial projection to provide a rotation axis to the upper body, and the spring may be inserted around an outer surface of the axial projection. The upper body may surround the spring and the axial projection, and may have an arm formed integrally therewith to extend in a direction to fix the support pulley at a position radially spaced apart from the rotation axis for the lower body.

Further, the sagging prevention mechanism may be installed with the support pulley supporting a lower outer circumferential surface of the unison ring. A plurality of sagging prevention mechanisms may be installed at a lower side of the unison ring to be spaced apart from each other. A plurality of guide rollers fixed to the nozzle ring may be disposed inside the unison ring to guide a position and a rotational motion of the unison ring. Each sagging prevention mechanism may be installed between the guide rollers located at the lower side of the unison ring to support the outer circumferential surface of the unison ring.

BRIEF DESCRIPTION OF THE DRAWINGS

The objects, features and advantages of the present invention will be more apparent from the following detailed description in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Figure 1:
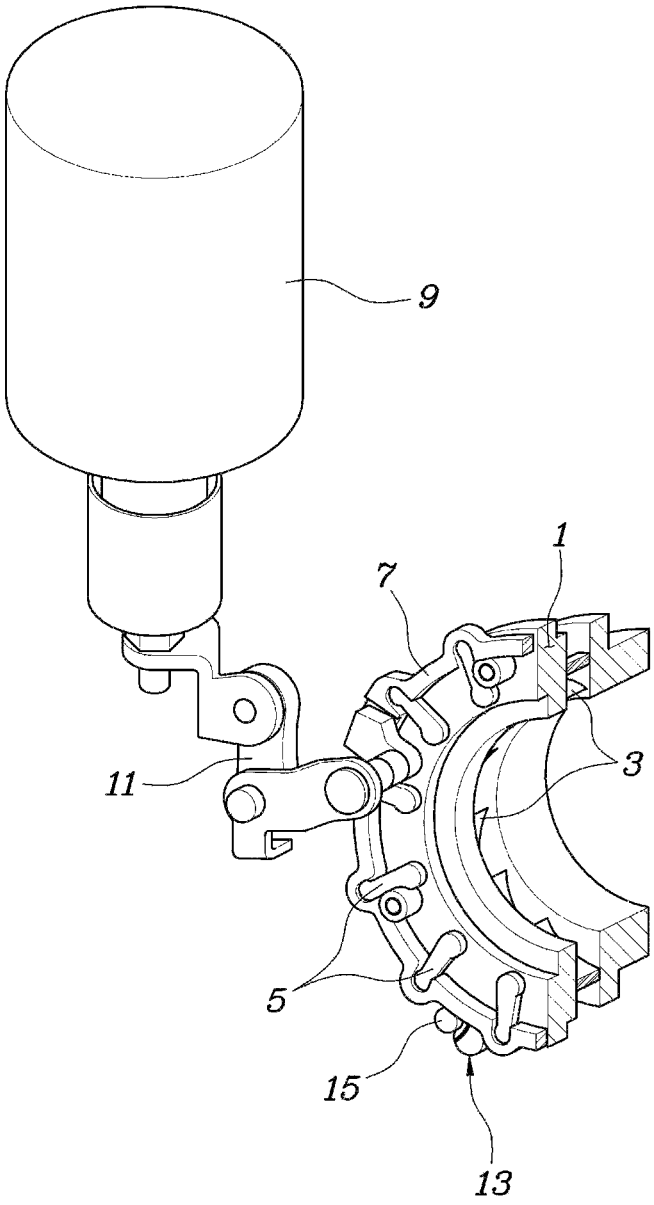
FIG. 1 is a view illustrating a main configuration of a variable geometry turbocharger according to an exemplar)/embodiment of the present disclosure.

FIG. 1 illustrates a partial configuration of a variable geometry turbocharger (VGT). A plurality of vanes 3 may be rotatably installed in a nozzle ring 1 fixed to a turbo housing. The rotation axis of each of the vanes 3 may be connected to a unison ring 7 through a unison lever 5. An actuator 9 may be connected to the unison ring 7 via a link 11. Accordingly, while the unison ring 7 is rotated by operation of the actuator 9 and all of the vanes 3 are rotated together due to the rotation of the unison ring 7, it may be possible to adjust flow of exhaust gas into the turbine wheel, which is located in the center portion of the nozzle ring 1 but not shown, through openings formed between the nozzle ring 1 and the vanes 3. Notably, the actuator 9 may be operated by a controller.

Referring to FIGS. 1 to 4, in an exemplary embodiment of the present disclosure, the variable geometry turbocharger may include at least one sagging prevention mechanism 13 installed to support the unison ring 7 in a direction opposite to a direction in which a self-weight of the unison ring 7 acts. The sagging prevention mechanism 13 may include a support pulley 15 installed to provide an elastic pressure on an outer circumferential surface of the unison ring 7 in rolling contact therewith. In other words, the support pulley 15 may be maintained in rolling contact with the outer circumferential surface of the unison ring 7 to minimize friction when the unison ring 7 is rotated, to thus prevent the unison ring 7 from sagging and ensuring smoother rotation.

In the exemplary embodiment, the sagging prevention mechanism 13 may include: a lower body 17 fixed to the nozzle ring 1; an upper body 19 installed in a rotatable state relative to the lower body 17 and configured to fix the support pulley 15 in the rotatable state; and a spring 21 installed to apply an elastic force in a rotational direction between the lower body 17 and the upper body 19. The lower body 17 may include an axial projection 23 to provide a rotation axis to the upper body 19, and the spring 21 may be inserted around an outer surface of the axial projection 23. The upper body 19 is structured to surround the spring 21 and the axial projection 23, and may include an arm 25 formed integrally therewith to extend in a direction to fix the support pulley 15 at a position radially spaced apart from the rotation axis for the lower body 17.

Thus, the elastic force may be applied by the spring 21 in the rotational direction to the upper body 19 with respect to the lower body 17, and the elastic supporting force may be provided to the outer circumferential surface of the unison ring 7 through the support pulley 15. The lower body 17 may be configured to be integrally formed in the nozzle ring 1. In particular, the axial projection 23 may protrude integrally from the nozzle ring 1.

Furthermore, the sagging prevention mechanism 13 may be installed with the support pulley 15 supporting a lower outer circumferential surface of the unison ring 7. In other words, since the self-weight of the unison ring 7 acts downwards, the support pulley 15 of the sagging prevention mechanism 13 may be installed at a lower side of the unison ring 7 to prevent the unison ring 7 from sagging. In addition, a plurality of sagging prevention mechanism 13 may be installed at the lower side of the unison ring 7 to be spaced apart from each other.

Figure 2:
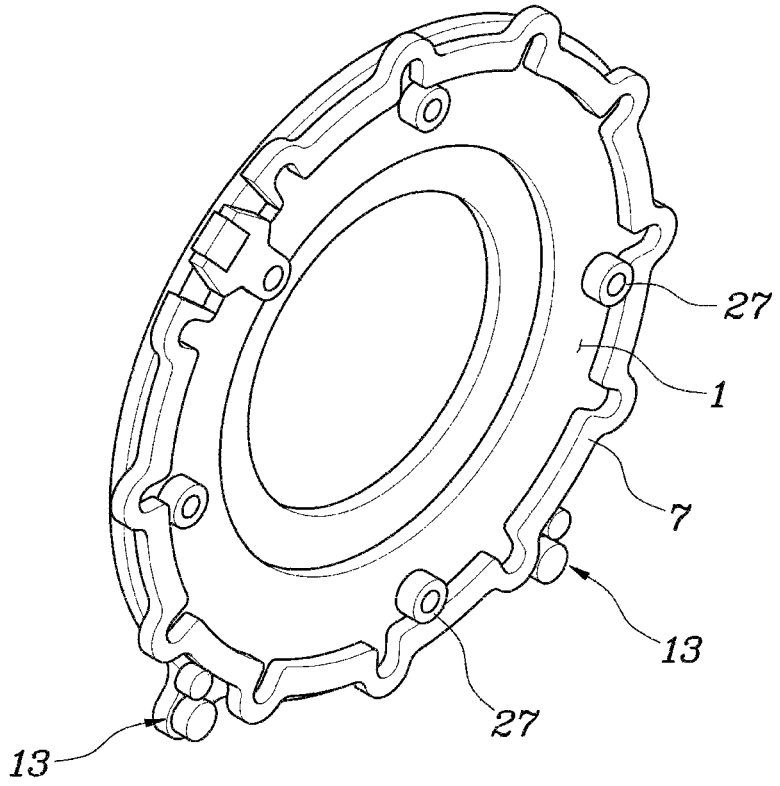
FIG. 2 is a view illustrating an embodiment in which a sagging prevention mechanism according to an exemplar)/embodiment of the present disclosure is installed.
Figure 3:
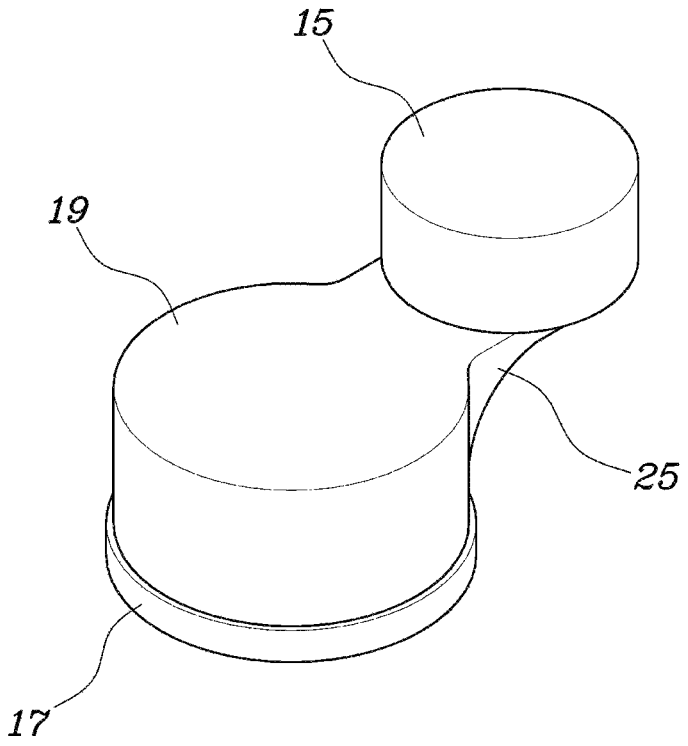
FIG. 3 is a view illustrating the sagging prevention mechanism of FIG. 2 according to an exemplary embodiment of the present disclosure.
Figure 4:
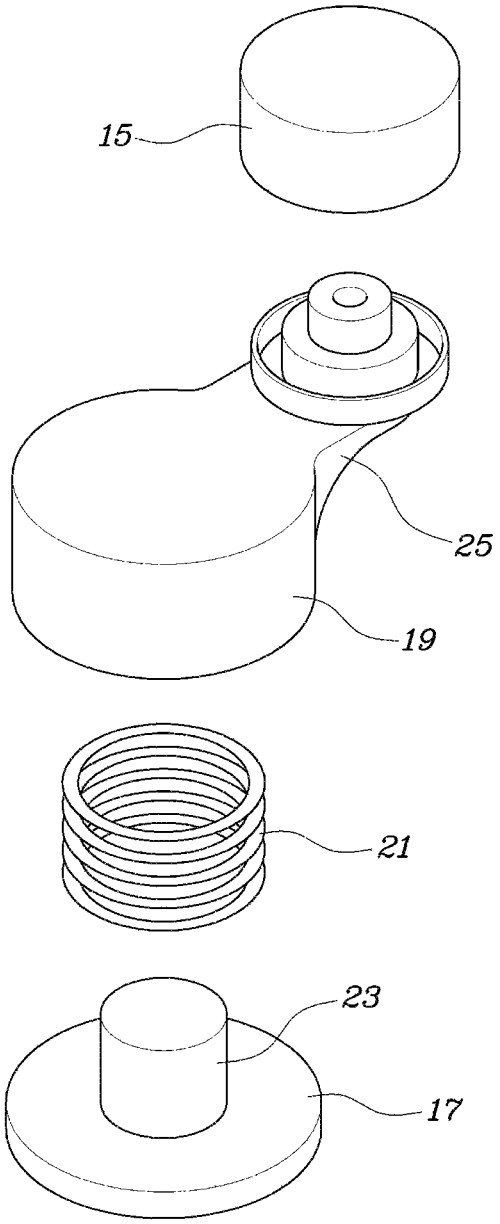
FIG. 4 is a detailed perspective view illustrating the sagging prevention mechanism of FIG. 3 according to an exemplar)/embodiment of the present disclosure.

In other words, as illustrated in FIG. 2, the sagging prevention mechanisms 13 may be installed on both sides of the vertical center of the unison ring 7 to be spaced apart from each other, thereby more stably preventing the unison ring 7 from sagging. In particular, a plurality of guide rollers 27 fixed to the nozzle ring 1 may be disposed inside the unison ring 7 to guide a position and a rotational motion of the unison ring 7. When the sagging prevention mechanism 13 is installed between the guide rollers 27 (e.g., each sagging prevention mechanism installed between each guide roller) disposed at the lower side of the unison ring 7 among all of the guide rollers 27 to support the outer circumferential surface of the unison ring 7, the guide rollers 27 and the support pulley 15 may support and guide the unison ring 7 along a circumferential direction of the unison ring 7 on an inner circumferential surface and the outer circumferential surface of the unison ring 7 in an alternating manner, to consistently maintain the position and the rotational motion of the unison ring 7 in a more stable and smooth state.

Even if abrasion is caused between the guide rollers 27 located at an upper side and the inner circumferential surface of the unison ring 7 due to the repeated rotations of the unison ring 7, which might result in a situation where the unison ring 7 sags due to the self-weight thereof, the support pulley 15 of the sagging prevention mechanism 13 supports the lower side of the unison ring 7 to prevent sagging. In addition, even if abrasion is caused between the support pulley 15 and the unison ring 7, the support pulley 15 may be consistently maintained in close adhesion to the unison ring 7 by the elastic force of the spring 21. Thus, the unison ring 7 may consistently be maintained in an initially assembled position. When the position of the unison ring 7 is maintained stably as described above, an angle of each of the vanes 3 driven by the unison ring 7 may be controlled more stably and accurately at all times, thereby resulting in a smoother supercharging effect of the VGT and making it possible to secure stable engine output performance.

The present disclosure is capable of stably supporting the position of the unison ring to suppress and prevent a change in the position of the unison ring from an initial state according to the change as the time for which the VGT has been used elapses, thereby improving accuracy and stability in controlling vanes in the VGT.

Although the present disclosure has been shown and described with respect to specific embodiments, it will be apparent to those having ordinary skill in the art that the present disclosure may be variously modified and altered without departing from the spirit and scope of the present disclosure as defined by the following claims.

What is claimed is:

1. A variable geometry turbocharger, comprising:

a unison ring provided to rotate a plurality of vanes disposed in a nozzle ring; and at least one sagging prevention mechanism installed to support the unison ring in a direction opposite to a direction in which a self-weight of the unison ring acts, wherein the at least one sagging prevention mechanism includes a support pulley installed to provide an elastic pressure on an outer circumferential surface of the unison ring in rolling contact therewith, and wherein the at least one sagging prevention mechanism includes:

a lower body fixed to the nozzle ring;

an upper body installed in a rotatable state relative to the lower body and configured to fix the support pulley in the rotatable state; and a spring installed to apply an elastic force in a rotational direction between the lower body and the upper body.

2. The variable geometry turbocharger of claim 1, wherein the lower body has an axial projection to provide a rotation axis to the upper body, the spring is inserted around an outer surface of the axial projection, and the upper body surrounds the spring and the axial projection, and has an arm formed integrally therewith to extend in a direction to fix the support pulley at a position radially spaced apart from the rotation axis for the lower body.

3. The variable geometry turbocharger of claim 1, wherein the at least one sagging prevention mechanism is installed with the support pulley supporting a lower outer circumferential surface of the unison ring.

4. The variable geometry turbocharger of claim 3, wherein a plurality of sagging prevention mechanisms are installed at a lower side of the unison ring to be spaced apart from each other.

5. The variable geometry turbocharger of claim 3, wherein a plurality of guide rollers fixed to the nozzle ring are disposed inside the unison ring to guide a position and a rotational motion of the unison ring.

6. The variable geometry turbocharger of claim 5, wherein each sagging prevention mechanism is installed between the guide rollers located at the lower side of the unison ring among all of the guide rollers to support the outer circumferential surface of the unison ring.

7. A vehicle, comprising:

a variable geometry turbocharger including:

a unison ring provided to rotate a plurality of vanes disposed in a nozzle ring; and at least one sagging prevention mechanism installed to support the unison ring in a direction opposite to a direction in which a self-weight of the unison ring acts, wherein the at least one sagging prevention mechanism includes a support pulley installed to provide an elastic pressure on an outer circumferential surface of the unison ring in rolling contact therewith, and wherein the at least one sagging prevention mechanism includes:

a lower body fixed to the nozzle ring;

an upper body installed in a rotatable state relative to the lower body and configured to fix the support pulley in the rotatable state; and a spring installed to apply an elastic force in a rotational direction between the lower body and the upper body.

8. The vehicle of claim 7, wherein the lower body has an axial projection to provide a rotation axis to the upper body, the spring is inserted around an outer surface of the axial projection, and the upper body surrounds the spring and the axial projection, and has an arm formed integrally therewith to extend in a direction to fix the support pulley at a position radially spaced apart from the rotation axis for the lower body.

* * * * *